US005360668A

United States Patent [19]

Sternlieb

[11] Patent Number: 5,360,668

[45] Date of Patent: Nov. 1, 1994

[54] UNITARY FIBER WHITE BLACKOUT FABRIC

[75] Inventor: Herschel Sternlieb, Brunswick, Me.

[73] Assignee: Charles Samelson Co., New York, N.Y.

[21] Appl. No.: 154,569

[22] Filed: Nov. 19, 1993

[51] Int. Cl.[5] ..... D02G 3/00

[52] U.S. Cl. ..... 428/372; 428/221; 428/240; 428/396; 524/495; 524/847; 524/497

[58] Field of Search ..... 524/495, 496, 497, 847; 428/364, 372, 221, 224, 240, 396

[56] References Cited

U.S. PATENT DOCUMENTS

| | | | |
|---|---|---|---|
| 2,132,457 | 10/1938 | Blackshaw . | |
| 2,875,171 | 2/1959 | Foster et al. | 524/847 |
| 2,884,010 | 4/1959 | Fischer . | |
| 3,066,358 | 12/1962 | Schiess . | |
| 3,493,452 | 2/1970 | Cole . | |
| 3,563,241 | 2/1971 | Evans et al. . | |
| 3,616,184 | 10/1971 | Katagiri et al. | 428/372 |
| 3,639,199 | 2/1972 | Brandts et al. . | |
| 3,761,345 | 9/1973 | Smith . | |
| 3,894,315 | 7/1975 | Fukuta et al. . | |
| 4,555,601 | 12/1985 | Kirayoglu . | |
| 4,612,237 | 9/1986 | Frankenburg . | |
| 4,615,717 | 10/1986 | Neubauer et al. . | |
| 4,851,467 | 7/1989 | Frayer | 524/847 |
| 4,888,127 | 12/1989 | Wada et al. | 524/847 |
| 4,950,531 | 8/1990 | Radwanski et al. . | |
| 4,997,712 | 3/1991 | Lin | 428/372 |
| 5,019,445 | 5/1991 | Sternlieb | 428/372 |
| 5,047,276 | 9/1991 | Chomarat et al. . | |
| 5,175,042 | 12/1992 | Chomarat . | |

FOREIGN PATENT DOCUMENTS

| | | |
|---|---|---|
| 4929464 | 9/1964 | Australia . |

*Primary Examiner*—Patrick J. Ryan
*Assistant Examiner*—N. Edwards
*Attorney, Agent, or Firm*—Cobrin Gittes & Samuel

[57] ABSTRACT

A white blackout fiber comprising a unitary fiber having a light blocking substance that substantially prevents the transmission of light therethrough and a whitening agent, where the whitening agent is present in an amount which provides for good after processing while the light blocking substance is present in the maximum amount which is masked by the whitening agent. Generally, the whitening agent is present in an amount between about 2.5–4% by weight of the fiber, and the whitening agent and light blocking substance are present in a ratio of between about 1000:1 and 800:1. Preferably, the whitening agent is $TiO_2$ and the light blocking substance is carbon black.

13 Claims, No Drawings

UNITARY FIBER WHITE BLACKOUT FABRIC

BACKGROUND OF THE INVENTION

This invention relates generally to fabrics, and more particularly, is directed to a white blackout drapery fabric.

Opaque fabrics used primarily for completely darkening or blackening out a window are well known in the art. Two general methods of manufacturing such fabrics are discussed in U.S. Pat. No. 5,019,445 to Sternlieb, the entire disclosure of which is incorporated herein by reference. These methods generally involve backing or laminating various foams or sheetings to the fabric.

Drawbacks of these methods include that the blackout fabrics produced are bulky and stiff, drape poorly and are difficult to launder. Further, such blackout fabrics tend to come apart or delaminate and they are difficult to stitch. It is also difficult to ensure that such blackout fabrics are fire retardant.

U.S. Pat. No. 5,019,445 to Sternlieb discloses a bi-component white blackout fiber containing a polymeric core component and a polymeric sheath. The polymeric core contains the light blocking substance and whitening agent is contained generally throughout the core and sheath. An opaque white blackout fiber is produced where the core of the fiber is sufficiently dark to prevent the transmission of light therethrough and the core and the surrounding sheath are sufficiently opaque to prevent viewing of the darker core space. The sheath fiber has good yarn processing qualities.

The bi-component white blackout fiber, however, is not commercially viable due primarily to the expense of its production.

The suggestion of a unitary fiber white blackout fabric would involve the use of a sufficient amount of $TiO_2$ to render the fiber opaque. Drawbacks apparent in this idea are that the resulting fiber would be brittle and difficult to handle, thereby creating difficulties with further processing of the fiber.

The present invention overcomes the problems in the art by providing a white blackout fiber consisting essentially of a unitary fiber having a light blocking substance that substantially prevents the transmission of light therethrough and a whitening agent, where the whitening agent is present in an amount between about 2.5–4% by weight of the fiber, and the whitening agent and light blocking substance are present in a ratio of between about 1000:1 and 800:1.

Accordingly, it is an object of the present invention to provide a blackout fabric that is substantially opaque to light.

It is still another object of the present invention to provide a blackout fabric having a unitary fiber.

It is another object of the present invention to provide a blackout fabric that allows for good after-processing, i.e., the fiber has good yarn spinning characteristics.

It is yet another object of the present invention to provide a blackout fabric which is commercially viable to produce.

It is a further object of the present invention to provide a blackout fabric having particular utility with drapery linings, printed and solid color hotel and motel draperies, theater curtains, and woven and non-woven vertical blinds.

It is another object of the present invention to provide a blackout fabric that presents a white appearance.

It is yet another object of the present invention to provide a blackout fabric that is aesthetically pleasing.

It is another object of the present invention to provide a blackout fiber that can be used with fabrics that are woven, knit, stitch bonded, needled, wet laid, dry laid, spun bonded and spun laced.

It is another object of the present invention to provide a blackout fabric that is soft.

It is yet another object to provide a blackout fabric that can be easily draped.

It is a further object of the present invention to provide a blackout fabric that can be dyed and printed upon.

It is a further object of the present invention to provide a blackout fabric having a pleasing hue.

It is a further object of the present invention to provide a blackout fabric which appears soft.

The above and other objects, features and advantages of the present invention will become readily apparent from the following detailed description.

DETAILED DESCRIPTION OF THE INVENTION

In accordance with the present invention, a white blackout fiber that is substantially opaque to light is constructed of a unitary fiber having a light blocking substance that substantially prevents the transmission of light therethrough and a whitening agent. The whitening agent is present in an amount which provides for good after-processing while the light blocking substance is present in the maximum amount which is masked by the whitening agent. The provision for good after-processing particularly includes yet is not limited to the fiber having good yarn spinning characteristics. In a preferred embodiment, the whitening agent is $TiO_2$ and the light blocking substance is carbon black. The fiber is preferably an F.R. (fire retardant) polyester component, although this is not essential to the invention. For example, other components such as standard polyesters, polyamides or chemical substances suitable for spinning into fibers may be used. The weight of the fiber is typically in the range of 1.5–8 denier.

Thus, by limiting the amounts of $TiO_2$ and carbon black dependent thereon in a unitary fiber in accordance with the present invention, a white yarn that is substantially opaque can be produced. A white blackout fiber is provided consisting essentially of a unitary fiber containing $TiO_2$ in an amount between about 2.5–4% by weight of the fiber, where $TiO_2$ and carbon black are present in a ratio of between about 1000:1 and 800:1. In keeping with these parameters, carbon black is present in the range of between about 0.0025–0.005%. In a preferred embodiment, $TiO_2$ is present at about 2.5% by weight of the fiber.

To provide a fabric with enhanced opacity, the utilization of heavier weight fabrics, i.e., in excess of 7 ounces/square yard, is preferred. A further advantage from such an embodiment obtains in the achievement of a fiber with a pleasing hue, for example, a brown rather than a gray hue. A small amount of yellow pigment may be added to cast the fiber from a gray to a brown hue, thereby making it more commercially acceptable. After hydraulic entanglement processing, the resulting fabric drapes well and may be described as having an especially soft appearance. This effect is particularly obtained at a ratio of $TiO_2$ to carbon black closer to 800:1, for example, between a ratio of about 900:1 and 800:1.

It will be appreciated that materials other than $TiO_2$ and/or carbon black can be utilized to construct the white blackout fiber constructed of a unitary fiber according to the present invention. However, the resulting fiber would still be substantially opaque to provide an aesthetically pleasing product with good after processing characteristics.

In order to better understand the invention, the following specific examples are set forth in which $TiO_2$ and carbon black are used in the above-recited ranges:

EXAMPLE 1

A unitary fiber of fire retardant polyester containing 3% $TiO_2$ and 0.003% carbon black spun into $12^5$ cotton count yarn—this yarn woven into a 2×1 twill with 75 ends and 50 picks per inch—the resulting fabric being approximately 12 ounces per linear yard—60" wide, and then finished by at least one of the following methods: pre-shrinking, calendaring and hydraulic entangling.

EXAMPLE 2

A unitary fiber of fire retardant polyester containing 2.5% $TiO_2$ and 0.0025% carbon black spun into $8^5$ cotton count yarn—this yarn woven into a 3×1 twill with 60 ends and 38 picks per inch—the resulting fabric being approximately 14 ounces per linear yard—60" wide, and then finished by at least one of the following methods: pre-shrinking, calendaring and hydraulic entangling.

A textile structure can be made opaque by using the aforementioned opaque fiber. This is so, regardless of the manner in which the fabric is formed. The present invention can be used with fabrics that are woven, knit, stitch bonded, needled, wet laid, spun bonded and spun laced.

Thus the present invention provides a white blackout fabric from unitary fiber which is substantially opaque to light, has good after processing characteristics, and is aesthetically pleasing. Specifically, the unitary fiber is sufficiently opaque to prevent the transmission of light therethrough yet is sufficiently white in color.

The present invention thereby has particular utility with drapery linings, printed and solid color hotel and motel draperies, theater curtains, and woven and non-woven vertical blinds. In this manner, the blackout fabric is soft, can be easily draped, and can be dyed and printed upon.

Having described specific preferred embodiments of the invention, it will be appreciated that the present invention is not limited to these precise embodiments, and that various changes and modifications may be effected therein by one of ordinary skill in the art without departing from the scope or spirit of the invention as defined in the appended claims.

What is claimed is:

1. A white blackout fiber consisting essentially of a unitary fiber having a light blocking substance that substantially prevents the transmission of light therethrough and a whitening agent, said whitening agent present in an amount between about 2.5–4% by weight of the fiber, said whitening agent and light blocking substance present in a ratio of between about 1000:1 and 800:1.

2. A white blackout fiber according to claim 1, wherein the unitary fiber is selected from the group consisting of polyesters and polyamides.

3. A white blackout fiber according to claim 2, wherein the unitary fiber is polyester.

4. A white blackout fiber according to claim 3, wherein the polyester is fire retardant.

5. A white blackout fiber according to claim 1, wherein the light blocking substance is carbon black.

6. A white blackout fiber according to claim 1, wherein the whitening agent is $TiO_2$.

7. A white blackout fiber according to claim 5, wherein $TiO_2$ is present at about 2.5% by weight of the fiber.

8. A white blackout fabric comprising fibers, said fibers consisting essentially of a unitary fiber having a light blocking substance that substantially prevents the transmission of light therethrough and a whitening agent, said whitening agent present in an amount between about 2.5–4% by weight of the fiber, said whitening agent and light blocking substance present in a ratio of between about 1000:1 and 800:1.

9. A white blackout fabric according to claim 8, wherein the fabric is heavy-weight fabric.

10. A white blackout fabric according to claim 9, wherein the weight of the fabric is in excess of 7 ounces/sq. yard.

11. A white blackout fabric according to claim 8, wherein the whitening agent and light blocking substance are present in a ratio of between about 900:1 and 800:1 and wherein the weight of the fabric is in excess of 7 ounces/sq. yard.

12. A white blackout fabric according to claim 11, wherein the ratio is about 800:1.

13. A white blackout fabric according to claim 11, further comprising yellow pigment.

* * * * *